United States Patent [19]

Taguchi et al.

[11] Patent Number: 4,945,009

[45] Date of Patent: Jul. 31, 1990

[54] ELECTROLUMINESCENCE DEVICE

[75] Inventors: Kazuo Taguchi, Tokyo; Moriaki Fuyama, Hitachi; Kenichi Onisawa, Hitachi; Katsumi Tamura, Hitachi; Yoshimasa Ono, Mito; Yoshio Abe; Takahiro Nakayama, both of Hitachi; Akira Sato, Takahagi; Kenichi Hashimoto, Katsuta, all of Japan

[73] Assignee: Hitachi, Ltd., Tokyo, Japan

[21] Appl. No.: 166,986

[22] Filed: Mar. 11, 1988

[30] Foreign Application Priority Data

Mar. 12, 1987 [JP] Japan ..... 62-57274

[51] Int. Cl.[5] ..... H05B 33/14; H05B 33/22

[52] U.S. Cl. ..... 428/690; 313/503; 313/506; 313/509; 428/917

[58] Field of Search ..... 428/690, 691, 917; 313/506, 503, 509

[56] References Cited

U.S. PATENT DOCUMENTS

| | | | |
|---|---|---|---|
| 2,925,532 | 2/1960 | Larach | 313/503 X |
| 3,531,585 | 9/1970 | Strain | 313/503 X |
| 4,396,864 | 8/1983 | Suntola et al. | 313/506 |
| 4,416,933 | 11/1983 | Antson et al. | 428/917 X |
| 4,666,793 | 5/1987 | Hirate | 428/691 X |
| 4,689,522 | 8/1987 | Robertson | 313/506 |
| 4,717,606 | 1/1988 | Hale | 428/917 X |
| 4,720,436 | 1/1988 | Ohseto et al. | 428/690 |
| 4,727,003 | 2/1988 | Ohseto et al. | 428/690 |
| 4,727,004 | 2/1988 | Tanaka et al. | 428/690 |

*Primary Examiner*—James Seidleck

*Attorney, Agent, or Firm*—Antonelli, Terry, Stout & Kraus

[57] ABSTRACT

In an electroluminescence element including light emitting layers emitting light by applying AC voltages thereto the light emitting layer consists of a light emitting layer emitting red light and a light emitting layer emitting bluish green light and a blue filter transmitting blue light and a green filter transmitting green light are disposed on the light emitting surface side of the bluish green light emitting layer. In this way it is possible to take out red, blue and green lights at an approximately equal brightness level and to realize full color.

31 Claims, 3 Drawing Sheets

ELECTROLUMINESCENCE DEVICE

BACKGROUND OF THE INVENTION

1. FIELD OF THE INVENTION

This invention relates to an EL (Electroluminescence) element emitting light by application of an AC electric field and in particular to a multicolor EL element capable of emitting 3-colored light, red, green and blue. This invention relates further to a light emission method using such an EL element.

2. DESCRIPTION OF THE PRIOR ART

A thin film EL element, in which there are disposed a plurality of filters, which cut-off or transmit only light having a specified wavelength region in the direction parallel to the light emitting surface of a layer emitting light having a relatively large emission spectrum width so as to give rise to light emission having a plurality of colors, is disclosed in JP-A-57-25692. Concretely speeking, it is disclosed there that ZnS, to which $PrF_3$ is added as activation material, is used as the light emitting layer, and red, bluish green and white colors are taken-out therefrom by means of a filter transmitting red light emission and another transmitting bluish green light emission.

However, by means of an element using only one kind of light emitting layers as by the prior art techniques described above, it is extremely difficult to obtain all the three primary colors, i.e., red, blue and green with a satisfactory brightness.

SUMMARY OF THE INVENTION

An object of this invention is to provide an EL element, by means of which it is possible to obtain all the three primary colors, red, blue and green with a satisfactory brightness.

Another object of this invention is to provide a method for obtaining light emission by means of the EL element stated above.

This invention consists in that an EL element is provided with a red light emitting layer presenting red light emission color and a bluish green light emitting layer presenting bluish green light emission color and that blue light is taken out from the light coming from the bluish green light emitting layer through a blue filter transmitting only blue light and green light is taken out therefrom through a green filter transmitting only green light.

CaS:Eu, SrS:Eu, ZnS:Sm, etc. are suitable for the red light emitting layer and SrS:Ce is suitable for the bluish green light emitting layer.

If it were possible to have all the three primary colors, red, blue and green, emitted with a satisfactory brightness, it would be possible to realize full color. However, in reality, it has not yet been realized to obtain all the three colors, red, blue and green with an almost equal brightness, Particularly to brightness of the blue light emitting layer is inferior.

Taking into account that a bluish green light emission having a brightness higher than that of the red light emission is available, the inventors of this invention have found an EL element structure, in which blue and green lights are taken out from the bluish green light emission by means of color filters and no filter is used for the red light emission.

According to this invention it is made unnecessary to use any color filter for the red light emitting layer by the fact that the EL element structure comprises 2 kinds of light emitting layers, i.e., a red light emitting layer and a bluish green light emitting layer, and that only light emitted by the bluish green light emitting layer is taken out through color filters, and thus the brightness is increased correspondingly. Concerning blue and green colors, it is possible to obtain blue light emission and green light emission having a high brightness and an excellent tone by taking out them from a high brightness bluish green color (SrS:Ce) through appropriate filters.

According to this invention the bluish green light emitting layer is made of SrS:Ce, i.e., SrS (strontium sulfide) as base material doped with Ce (cerium) as activation material and the red light emitting layer is made of CaS:Eu or SrS:Eu, i.e., CaS (calcium sulfide) or SrS as base material doped with Eu (europium) as activation material, or ZnS:Sm, i.e., ZnS (zinc sulfide) as base material doped with Sm (samarium). An EL element can be obtained by disposing a filter transmitting blue color light emission and a filter transmitting green color light emission at arbitrary positions on the light emitting surface of the bluish green light emitting layer thus constructed.

The EL element has, in general, a first electrode disposed on a substrate, a first insulating layer disposed thereon, the light emitting layer disposed thereon, a second insulating layer disposed thereon, and a second electrode disposed further thereon. It comprises further an AC power source connected with the first and the second electrodes. Either one of the surfaces of the light emitting layer is the light emitting surface.

In the EL element having such a construction according to this invention the light emitting layer is composed of 2 sorts of light emitting layers, i.e., a light emitting layer consisting only of a component emitting red light and another light emitting layer consisting only of a component emitting bluish green light, which are provided with an AC power source for exciting the red light emitting layer and another AC power source for exciting the bluish green light emitting layer, as indicated in FIG. 5 explained later.

The red light emitting layer and the bluish green light emitting layer may be juxtaposed on one same plane, as indicated in FIG. 5. However, they may be also so arranged that an EL element provided with the red light emitting layer and an EL element provided with the bluish green light emitting layer are opposite to each other, as indicated in FIG. 1.

For realizing this invention it is desirable that the area of red light emitting pixels is enlarged by making the width of the electrode relating to the red light emission having a low brightness greater than that relating to the bluish green light emission so as to increase the brightness of the red color.

The multicolor EL element according to this invention has an advantage that the driving voltage is significantly lowered, because the red light emitting layer and the bluish green light emitting layer are separately driven.

DESCRIPTION OF THE PREFERRED EMBODIMENTS

Some preferred embodiments of this invention will be explained below, but this invention is not at all restricted to these embodiments.

EMBODIMENT 1

Figure 1:
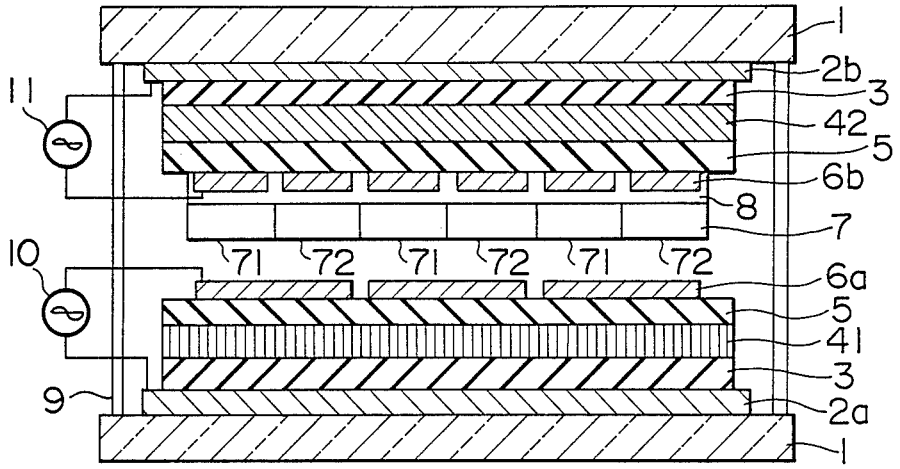
FIG. 1 is a cross-sectional view illustrating schematically an embodiment of this invention.

FIG. 1 is a schematical cross-sectional view of a multicolor EL element fabricated according to this embodiment. At first the fabrication process for the element indicated in FIG. 1 will be explained. Corning 7069 is used for a glass substrate 1 in all the cases. A first electrode 2a is formed on the glass substrate 1 in the form of stripes 2.25 mm wide with an interval of 0.25 mm by photoetching a thin film about 0.2 μm thick of transparent ITO (oxide of indium and tin, abbreviation of Indium Tin Oxide, $In_2O_3$ doped with $SnO_2$ at several %) formed by the high frequency sputtering method (hereinbelow abbreviated to RF sputtering method). Another first electrode 2b is formed on another glass substrate in the form of stripes 1 mm wide with an interval of 0.25 mm made of metallic aluminum (A1) about 0.2 μm thick by the electron beam evaporation method using a metallic mask. First insulating layers 3 on the first electrodes 2a and 2b are formed by the RF sputtering method in a same batch by superposing $Ta_2O_5$ 0.4 μm thick on $SiO_2$ 0.1 μm thick. The light emitting layers are formed thereon. The red light emitting layer 41 is formed to a layer thickness of about 1 μm by the electron beam evaporation method using sintered powder as the starting material, which consists of CaS as the base material doped with Eu as the activation material at 0.3 mol %. On the other hand, the bluish green light emitting layer 42 is formed to a film thickness of about 1 μm by the electron beam evaporation method using sintered powder as the starting material, which consists of SrS as the base material doped with Ce as the activation material at 0.1 mol %. In the electron beam evaporation for fabricating the light emitting layers of CaS:Fu and SrS:Ce, in order to prevent the shortage of sulfur, sulfur set in the same vacuum chamber is evaporated by the resistor heating method and deposited at the same time as the evaporation of the starting materials stated above. The area of light emitting pixels in the red light emitting layer 41 is greater than either one of the areas of blue and green light emitting pixels and approximately equal to the sum of them.

Second insulating layers 5 disposed on the red light emitting layer 41 made of CaS:Eu and the bluish green light emitting layer 42 made of SrS:Ce are formed by the method completely identical to that used for fabricating the first insulating layers 3. The transparent second electrodes 6a and 6b on the second insulating layers are deposited to a layer thickness of about 0.2 μm by the RF sputtering method in a same vacuum chamber. The second electrodes are made of ITO. After that they are patterned by dry etching. By this patterning the second electrode 6a is formed into elements 2.25 mm wide with an interval of 0.25 mm and the second electrode 6b is formed into elements 1 mm wide with an interval of 0.25 mm. On the second electrode 6b green filters 71 having a function of cutting-off the blue component of the emitted light and transmitting the green component of the emitted light (green filters transmitting only the wavelengths longer than 500 nm) and blue filter 72 having a function of cutting-off the green component of the emitted light and transmitting the blue component of the emitted light (blue filters transmitting only the wavelengths shorter than 500 nm) are arranged on a plane and fixed with adhesive of epoxy resin 8. Here each of the used color filters is slightly larger than each of the elements constituting the second electrode 6b. These color filters may be fixed also by means of an extremely thin glass plate. Further the position where these color filters are located is not restricted on the second electrode, but they may be located at an arbitrary position between the light emitting surface of the light emitting layer and the upper surface of the second electrode as in this embodiment. For the sake of simplicity of the mounting it is desirable to dispose them on the second electrode.

2 EL elements of double insulating layer structure obtained by the various processes described above are put together so that their glass substrates are at the outermost positions. The periphery of the layers thus superposed between the two glass substrates is sealed with adhesive of epoxy resin 9 in nitrogen atmosphere.

Figure 2:
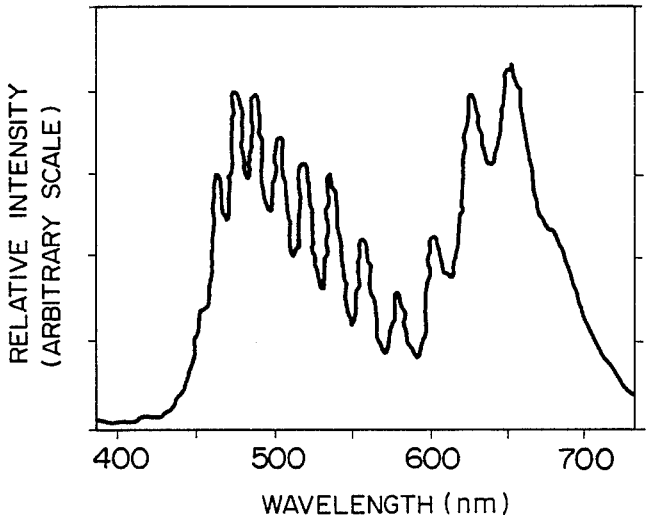
FIG. 2 indicates a white light emission spectrum of an EL element according to the embodiment of this invention.

An AC power source 10 is connected between the first electrode 2a and the second electrode 6a of an EL element having the structure fabricated in this way and indicated in FIG. 1 and another AC power source 11 is connected between the first electrode 2b and the second electrode 6b in order to apply AC voltages of same level so as to give rise to EL light emission. FIG. 2 indicates the emission spectrum in this case. It has a spectrum, for which the wavelength of the emitted light extends over a wide region from about 450 nm to about 700 nm and the whole EL element emits white light. It is because the spectrum depends on the visual sensitivity that the peak of the spectrum at the neighborhood of 550 nm is weak. The red light emission peak is near 650 nm and the bluish green light emission peak is near 475 nm. As it is clear from this embodiment, the red light emission (CaS:Eu), which should have originally a brightness lower than that of the bluish green light emission, is not inferior and has an intensity approximately as high as the emission peak (at the neighborhood of 475 nm) of the bluish green light. This is because the area of the light emission pixels in the red light emission layer is larger than those in the blue and the green light emission layers so that the level of the brightness is nearly equal for the red, the blue and the green light emissions, which is an effect of this invention.

Figure 3:
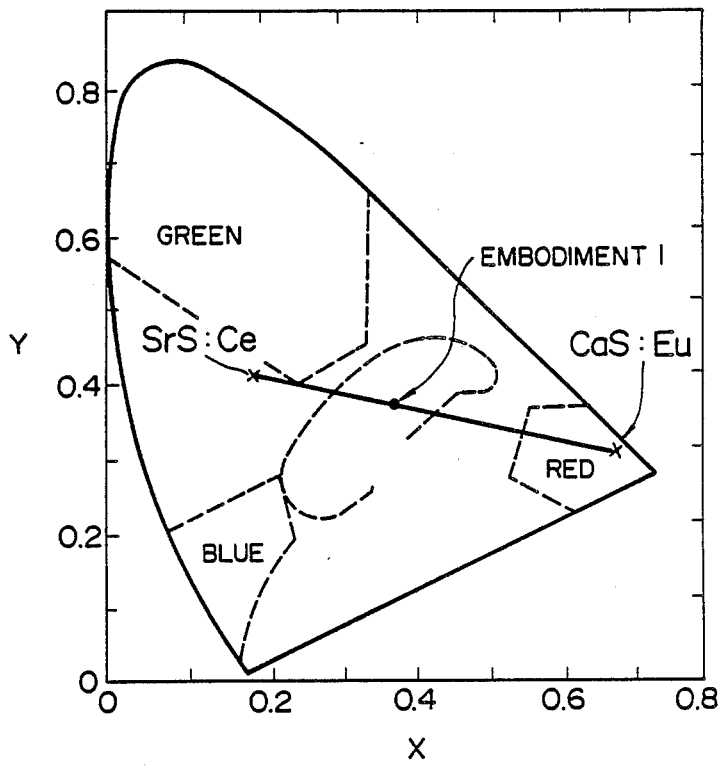
FIG. 3 is a CIE chromaticity diagram.

FIG. 3 shows a CIE (Commission Internationale d'Enluminure) chromaticity diagram. This diagram express all the color Tones with x-y coordinates and the left bottom corresponds to blue, the left top to green and the right end to red. The region indicated by a broken line at the central portion represents the white region. The point at the center represents the chromaticity ($x=0.37$, $y=0.38$) of the multicolor EL element according to this invention, in the case where the EL light emission indicated in FIG. 2 is effected, and it can be known that it presents a white light having a very good color tone.

Figure 4:
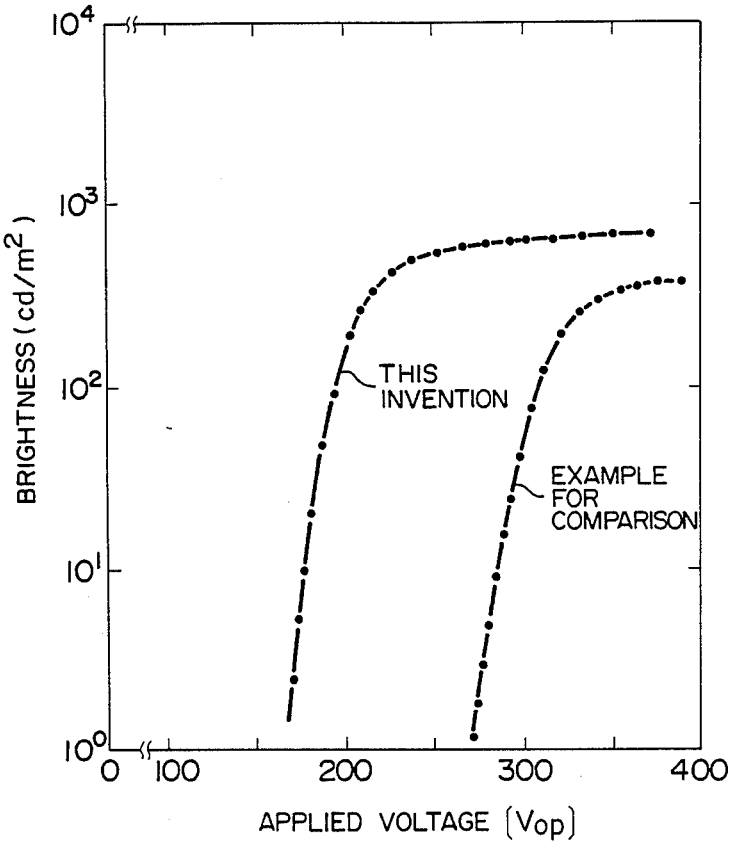
FIG. 4 shows characteristic curves indicating the relation between the brightness and the applied voltage.

AC voltages were applied between the first electrode 2a and the second electrode 6a and between the first electrode 2b and the second electrode 6b of the EL element fabricated in Embodiment 1 so as to produce the white EL emission so that the brightnesses of the various colors were at a same level and they were measured by means of a brightness meter (spectroscopic emission measuring instrument fabricated Photo Research Co.). The relation between the brightness and the applied voltage based on this result is plotted in FIG. 4.

The example for comparison represents the corresponding result obtained by using an element, in which 2 light emitting layers of CaS:Eu and SrS:Ce are superposed. It can be known from this comparison that the brightness of the multicolor EL element according to this invention is higher than that of the multilayered EL element and that it emits light with a very low applied voltage. It is because in the EL element according to this invention no color filter is used for the red light emitting layer, whose brightness is low and the light emitting pixels in the red light emitting layer is larger than those in the blue and the green light emitting layers that the brightness is high. It is because an EL element including the red light emitting layer made of CaS:Eu and an EL element including the bluish green light emitting layer made of SrS:Ce are driven separately so that it is possible to use a small layer thickness between the two electrodes of each of the EL elements that they emit light with low applied voltages. In the example for comparison, since two layers are superposed, the layer thickness is twice as great as that in the EL element according to this invention. In the thickness were smaller, no satisfactory brightness would be obtained. As explained above, it can be understood that such a structure as the EL element according to this invention can exhibit excellent characteristics both in the applied voltage and in the brightness.

EMBODIMENT 2

Figure 5:
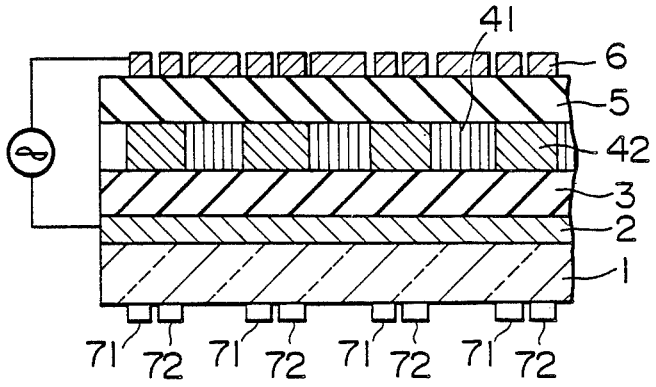
FIG. 5 is a cross-sectional view illustrating schematically another embodiment of this invention.

FIG. 5 is a cross-sectional view illustrating schematically a multicolor EL element fabricated in this embodiment. The fabrication process of this EL element will be described below. A transparent electrode 2, insulating layers 3 and 5, a light emitting layer 4 and an Al electrode 6 are formed one after another on a glass substrate 1 similar to that used for Embodiment 1. The fabrication method of these layers is identical to that described for Embodiment 1 except for the light emitting layer 4, which is formed by the electron beam evaporation method with a metallic mask having holes 2.5 mm wide with an interval of 2.5 mm. At first a red light emission layer 41 made of CaS:Eu is formed and then a bluish green light emitting layer 42 made of SrS:Ce is formed at the portion, where the red light emitting layer is not formed, after having displaced the metallic mask in the direction perpendicular to the holes and parallel to the light emitting layer.

When the light emitting layer is formed by this method, elements of the red light emitting layer 41 made of CaS:Eu and those of the bluish green light emitting layer 42 made of SrS:Ce are arranged alternately in one plane on the first insulating layer 3. At this time, in the electron beam evaporation of CaS:Eu and SrS:Ce, as in Embodiment 1, sulfur (S) is deposited by the resistance heating method at the same time as the evaporation of the materials stated above. Further for the second electrode 6 2 stripes 1 mm wide with an interval of 0.25 mm are formed on each element of the light emitting layer 42 made of SrS:Ce and one stripe 2.5 mm wide is formed on the light emitting layer 41 made of CaS:Eu. At the last process a filter 72 transmitting emitted light, whose wavelength is below 500 nm, i.e. a blue filter cutting-off green light and transmitting blue light and a filter 71 transmitting emitted light, whose wavelength is over 500 nm, i.e. a green filter cutting-off blue light and transmitting green light are mounted on the rear surface of the glass substrate 1. This color filter is mounted at the position according with the second electrode (Al) relating to the bluish green light emitting layer made of SrS:Ce.

Also in the case of the multicolor EL element of Embodiment 2 described above, it is possible to lower the driving voltage and to increase the brightness, as explained in Embodiment 1. All the pixels were made emit light and the relation between the brightness and the applied voltage (driving voltage) was measured. Results, which are nearly equal to those indicated in FIG. 4 for Embodiment 1, have been obtained.

By using the multicolor EL element according to this invention, since it is possible to increase the brightness of the red light emitting layer having otherwise a low brightness, an effect can be obtained that the brightness of the whole multicolor EL display is increased. Further, since the number of the superposed light emitting layers for obtaining multicolor is small, another effect is obtained that a high brightness multicolor device can be obtained, even if it is driven with a low voltage.

According to this invention, since it is possible to take out red, blue and green light at an approximately same brightness level, an effect can be obtained that it is extremely easy to obtain full color by combining arbitrarily these colors.

We claim:

1. An electroluminescence element comprising:

a structure, in which a first electrode, a first insulating layer, a light emitting layer, a second insulating layer and a second electrode are superposed one after another on a substrate; and AC power sources connected between said first electrode and said second electrode;

wherein said light emitting layer comprises a bluish green light emitting sub-layer made of SrS as base material doped with Ce as activation material and a red light emitting sub-layer made of one selected from the group consisting of CaS as base material doped with Eu as activation material, ZnS as base material doped with Sm as activation material, and SrS as base material doped with Eu as activation material, said bluish green light emitting sub-layer being provided with a blue filter transmitting only blue light and a green filter transmitting only green light in the light emitted by said bluish green light emitting sub-layer, the brightness of the red, blue and green lights being substantially uniform, whereby three separate colors are transmitted from the red and bluish green light emitting sub-layers, and one of said AC power sources is for exciting said red light emitting layer and the other of said AC power sources is for exciting said bluish green light emitting layer.

2. An electroluminescence element according to claim 1, wherein the area of light emitting pixels in said red light emitting sub-layer is greater than each of the area of blue light emitting pixels and the area of green light emitting pixels in said bluish green light emitting layer so that the brightness level is approximately equal for the red, the blue and the green light emissions.

3. An electroluminescence element according to claim 1, wherein a blue filter transmitting only blue light and a green filter transmitting only green light are disposed at an arbitrary position between the light emitting layer on the light emitting surface side of said bluish green light emitting sub-layer and the surface of said electroluminescence element.

4. An electroluminescence element according to claim 1, wherein one of the first and second electrodes is divided into electrode elements for providing blue light and green light, and the blue and green filters respectively corresponding to the electrode elements for providing blue light and green light are larger than the respective electrode elements.

5. An electroluminescence element according to claim 1, wherein the red light emitting sub-layer is not provided with a filter.

6. An electroluminescence element comprising:

a first electroluminescence element including a first electrode, a first insulating layer, a red light emitting layer, a second insulating layer and a second electrode superposed one after another on a substrate, and an AC power source applying an AC voltage between said first electrode and said second electrode, said red light emitting layer being made of one selected from the group consisting of CaS as base material doped with Eu as activation material, ZnS as base material doped with Sm as activation material, and SrS as base material doped with Eu as activation material, and a second electroluminescence element superposed on said first electroluminescence element including a first electrode, a first insulating layer, a bluish green light emitting layer, a second insulating layer and a second electrode superposed one after another on a substrate, said bluish green light emitting layer being provided with a blue filter transmitting only blue light and a green filter transmitting only green light in the light emitted by said bluish green light emitting layer, the brightness of the red, blue and green lights being substantially uniform, whereby three separate colors are transmitted from the first and second electro-luminescence elements, and an AC power source applying an AC voltage between said first electrode and said second electrode for exciting said bluish green light emitting layer, said bluish green light emitting layer being made of SrS as base material doped with Ce as activation material.

7. An electroluminescence element according to claim 6, wherein the area of light emitting pixels in said red light emitting layer is greater than each of the area of blue light emitting pixels and the area of green light emitting pixels in said bluish green light emitting layer so that the brightness level is approximately equal for the red, the blue and the green light emissions.

8. An electroluminescence element according to claim 6, wherein a blue filter transmitting only blue light and a green filter transmitting only green light are disposed at an arbitrary position between the light emitting layer on the light emitting surface side of said bluish green light emitting layer and the surface of said electroluminescence element.

9. An electroluminescence element according to claim 6, wherein one of the first and second electrodes is divided into electrode elements for providing blue light and green light, and the blue and green filters respectively corresponding to the electrode elements for providing blue light and green light are larger than the respective electrode elements.

10. An electroluminescence element according to claim 3, wherein the area of light emitting pixels in the red light emitting layer is greater than either of the areas of blue light and green light emitting pixels.

11. An electroluminescence element according to claim 10, wherein the area of light emitting pixels in the red light emitting layer is approximately equal to the sum of the areas of blue light and green light emitting pixels.

12. An electroluminescence element according to claim 6, wherein the red light emitting layer is not provided with a filter.

13. An electroluminescence element comprising:

a structure, in which a first electrode, a first insulating layer, a light emitting layer, a second insulating layer and a second electrode are superposed one after another on a substrate; and AC power sources applying AC voltages between said first electrode and said second electrode;

wherein said light emitting layer comprises red light emitting elements made of one selected from the group consisting of CaS as base material doped with Eu as activation material, ZnS as base material doped with Sm as activation material, and SrS as base material doped with Eu as activation material and bluish green light emitting elements made of SrS as base material doped with Ce as activation material, said red and said bluish green light emitting elements being disposed alternately on a same plane, each of said bluish green light emitting elements being provided with a blue filter transmitting only blue light and a green filter transmitting only green light in the light emitted by each of said bluish green light emitting elements, the brightness of the red, blue and green lights being substantially uniform, whereby three separate colors are transmitted from the red and bluish green light emitting elements, and one of said AC power sources is for exciting said red light emitting elements and the other of said AC power sources is for exciting said bluish green light emitting elements.

14. An electroluminescence element according to claim 13, wherein the area of light emitting pixels in said red light emitting elements is greater than each of the area of blue light emitting pixels and the area of green light emitting pixels in said bluish green light emitting elements so that the brightness level is approximately equal for the red, the blue and the green light emissions.

15. An electroluminescence element according to claim 13, wherein a blue filter transmitting only blue light and a green filter transmitting only green light are disposed at an arbitrary position between the light emitting layer on the light emitting surface side of said bluish green light emitting elements and the surface of said electroluminescence element.

16. An electroluminescence element according to claim 13, wherein one of the first and second electrodes is divided into electrode elements for providing blue light and green light, and the blue and green filters respectively corresponding to the electrode elements for providing blue light and green light are larger than the respective electrode elements.

17. An electroluminescence element according to claim 13, wherein the red light elements are not provided with a filter.

18. An electroluminescence element having a light emitting layer emitting light by applying an AC voltage thereto, comprising:

a red light emitting layer made of calcium sulfide doped with europium and a bluish green light emitting layer made of strontium sulfide doped with cerium constituting said light emitting layer; and blue filters transmitting only blue light and green filters transmitting only green light in the light emitted by said bluish green light emitting layer, whereby three colors can be transmitted from the red light and bluish green light emitting layers;

wherein the area of light emitting pixels in said red light emitting layer is greater than each of the area of blue light emitting pixels and the area of green light emitting pixels in said bluish green light emitting layer so that the brightness level is approximately equal for the red light emitted by said red light emitting layer, the blue and the green lights emitted by said bluish green light emitting layer through said blue and said green filters, respectively.

19. An electroluminescence display device comprising:

a first electroluminescence element including a first substrate, a first electrode formed on said first substrate, a first insulating layer covering said first electrode, a first light emitting layer for emitting light of first and second colors, formed on said first insulating layer, a second transparent insulating layer covering said first light emitting layer and a second transparent electrode formed on said second insulating layer;

a second electroluminescence element including a second transparent substrate, a third transparent electrode formed on said second substrate, a third transparent insulating layer covering said third electrode, a second transparent light emitting layer for emitting light of a third color, formed on said third transparent insulating layer, a fourth transparent insulating layer covering said second light emitting layer, a fourth transparent electrode formed on said fourth transparent insulating layer;

a first filter for transmitting light of the first color, of the light of the first and second colors emitted from the first light emitting layer;

a second filter for transmitting light of the second color, of the light of the first and second colors emitted from the first light emitting layer, said first and second filters being arranged side by side, whereby three separate colors are transmitted from the first and second light emitting layers; and an AC power source for applying AC power to said electrodes; wherein said second and third electrodes face each other through said first and second filters;

20. An electroluminescence display device according to claim 19, wherein the light of first and second colors is bluish green light, wherein said first filter is for transmitting blue light, and wherein said second filter is for transmitting green light.

21. An electroluminescence display device according to claim 19, wherein said first light emitting layer is made of SrS as base material doped with Ce as activation material, and said second light emitting layer is made of one selected from the group consisting of CaS as base material doped with Eu as activation material, ZnS as base material doped with Sm as activation material, and SrS as base material doped with Eu as activation material.

22. An electroluminescence display device comprising:

a structure, in which a first electrode, a first insulating layer, a light emitting layer, a second insulating layer and a second electrode are superposed one after another on a substrate; and AC power sources applying AC voltages between said first electrode and said second electrode;

wherein said light emitting layer comprises first light emitting elements emitting light of a first color, and second light emitting elements emitting light of second and third colors, disposed on a same plane; and wherein said structure further includes a first filter for transmitting light of the second color, of the light of the second and third colors emitted from the second light emitting elements, and a second filter for transmitting light of the third color, of the third of the second and third colors emitted from the second light emitting elements, whereby three separate colors are transmitted from the first and second light emitting elements.

23. An electroluminescence display device according to claim 22, wherein the light of the second and third colors is bluish green light, wherein said first filter is for transmitting blue light, and wherein said second filter is for transmitting green light.

24. An electroluminescence display device according to claim 22, wherein said first light emitting elements and said second light emitting elements are disposed alternately on the same plane.

25. An electroluminescence display device according to claim 24, wherein the first and second filters are disposed on a surface of said substrate opposed to a surface of the substrate on which the first electrode is disposed.

26. An electroluminescence display device according to claim 22, wherein the first and second filters are disposed on a surface of said substrate opposed to a surface of the substrate on which the first electrode is disposed.

27. An electroluminescence display device comprising:

a structure, including a first electrode, a first insulating layer, a light emitting structure, a second insulating layer and a second electrode;

at least one AC power source, connected between said first electrode and said second electrode;

wherein said light emitting structure comprises first light emitting elements emitting at least first and second colors, and second light emitting elements emitting a third color; and wherein the structure further includes a first filter for transmitting said first color from said first light emitting elements, and a second filter for transmitting said second color from said first light emitting elements, whereby three separate colors are transmitted from the first and second light emitting elements.

28. An electroluminescence display device according to claim 27, wherein said first color is blue and said second color is green, and wherein said third color is red.

29. An electroluminescence display device according to claim 27, wherein the first and second light emitting elements are disposed in the same plane, between the first and second insulating layers which are between the first and second electrodes.

30. An electroluminescence display device according to claim 27, wherein the first electrode, first insulating layer, first light emitting elements, second insulating layer and second electrode, stacked one on the other, form a first display element, and wherein the device further comprises:

a third electrode, a third insulating layer, a fourth insulating layer and a fourth electrode, with at least one further AC source, connected between the third and fourth electrodes; and wherein said third electrode, said third insulating film, said second light emitting elements, said fourth insulating layer and said fourth electrode, stacked one on the other, form a second display element.

31. An electroluminescence display device according to claim 30, wherein said first and second filters are disposed between the first and second display elements.

* * * * *